US007574925B2

(12) United States Patent
Khoshnevis

(10) Patent No.: US 7,574,925 B2
(45) Date of Patent: Aug. 18, 2009

(54) METERING AND PUMPING DEVICES

(75) Inventor: Behrokh Khoshnevis, Marina del Rey, CA (US)

(73) Assignee: University of Southern California, Los Angeles, CA (US)

( * ) Notice: Subject to any disclaimer, the term of this patent is extended or adjusted under 35 U.S.C. 154(b) by 0 days.

(21) Appl. No.: 11/933,985

(22) Filed: Nov. 1, 2007

(65) Prior Publication Data

US 2008/0121013 A1 May 29, 2008

Related U.S. Application Data

(60) Provisional application No. 60/864,060, filed on Nov. 2, 2006, provisional application No. 60/864,291, filed on Nov. 3, 2006.

(51) Int. Cl.
*G01F 1/37* (2006.01)

(52) U.S. Cl. ..... 73/861.52

(58) Field of Classification Search ..... 73/861.52, 73/217; 417/269, 270, 271, 273, 412; 137/565.3
See application file for complete search history.

(56) References Cited

U.S. PATENT DOCUMENTS

| | | | | |
|---|---|---|---|---|
| 984,517 | A | 2/1911 | Rollinger | |
| 1,381,864 | A * | 6/1921 | Evans et al. | 73/217 |
| 1,578,511 | A | 3/1926 | Gladwin | |
| 3,221,456 | A | 12/1965 | Vevoda | |
| 3,562,991 | A | 2/1971 | Kustusch | |
| 3,966,533 | A | 6/1976 | Goldsworthy | |
| 4,066,723 | A | 1/1978 | King et al. | |
| 4,449,507 | A * | 5/1984 | Mayer | 123/467 |
| 4,832,072 | A * | 5/1989 | Hechler et al. | 137/99 |
| 4,833,855 | A | 5/1989 | Winter, IV | |
| 4,850,382 | A | 7/1989 | Williams | |
| 4,936,111 | A * | 6/1990 | Wilkinson et al. | 62/504 |
| 5,059,266 | A | 10/1991 | Yamane et al. | |
| 5,529,471 | A | 6/1996 | Khoshnevis | |
| 5,617,515 | A | 4/1997 | MacLaren | |

(Continued)

FOREIGN PATENT DOCUMENTS

WO WO 03/086717 10/2003

OTHER PUBLICATIONS

International Search Report PCT/US07/83373. International filing date Nov. 1, 2007. Date of mailing May 15, 2008.

*Primary Examiner*—Jewel Thompson
(74) *Attorney, Agent, or Firm*—McDermott Will & Emery LLP

(57) ABSTRACT

The present disclosure presents several embodiments for metering devices some of which also have pumping capability. The devices utilize one or more pistons located within a cylindrical rotor. As the cylindrical rotor is turned by a suitable torque/power source, a first face of each piston is exposed to an inlet supplying a fluid to be metered. The piston is then moved within the associated channel or bore within the rotor, allowing the volume of the channel to be filled with fluid. The continuing rotation of the rotor then removes the piston from the fluid supply and moves the channel through an angular displacement. The piston is then moved—either through applied power for active pistons or the force of the fluid supply for passive pistons—in the opposite direction, forcing the fluid out of the channel. In this way, a precise amount of fluid can be metered from each channel.

19 Claims, 8 Drawing Sheets

U.S. PATENT DOCUMENTS

| | | | | |
|---|---|---|---|---|
| 5,656,230 | A | 8/1997 | Khoshnevis | |
| 5,664,382 | A | 9/1997 | Melnick et al. | |
| 5,749,196 | A | 5/1998 | Bangma | |
| 6,001,181 | A | 12/1999 | Bullen | |
| 6,103,161 | A | 8/2000 | Lopez | |
| 6,170,220 | B1 | 1/2001 | Moore, Jr. | |
| 6,363,683 | B1 | 4/2002 | Moore, Jr. | |
| 6,423,261 | B1 | 7/2002 | Joseph et al. | |
| 6,485,263 | B1 * | 11/2002 | Bryant et al. | 417/53 |
| 6,662,516 | B2 | 12/2003 | Vandehey et al. | |
| 6,672,848 | B2 * | 1/2004 | Yang | 417/462 |
| 6,957,604 | B1 * | 10/2005 | Tiedemann et al. | 91/506 |
| 7,153,454 | B2 | 12/2006 | Khoshnevis | |
| 7,287,516 | B2 * | 10/2007 | Elliot et al. | 123/500 |
| 2003/0004599 | A1 | 1/2003 | Herbak | |
| 2005/0196482 | A1 | 9/2005 | Khoshnevis | |

* cited by examiner

FIG. 2A
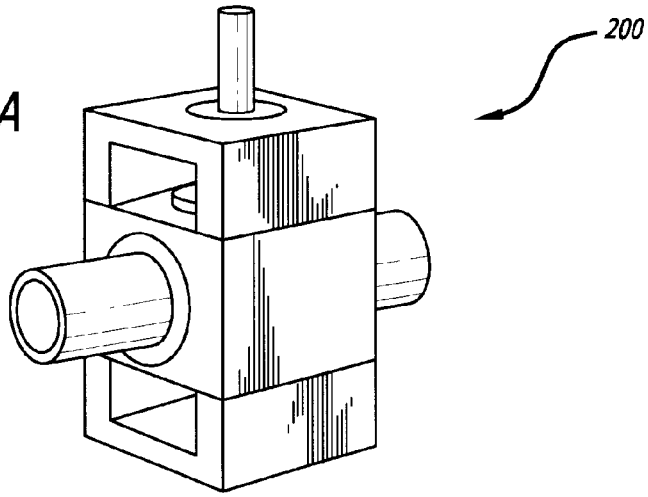
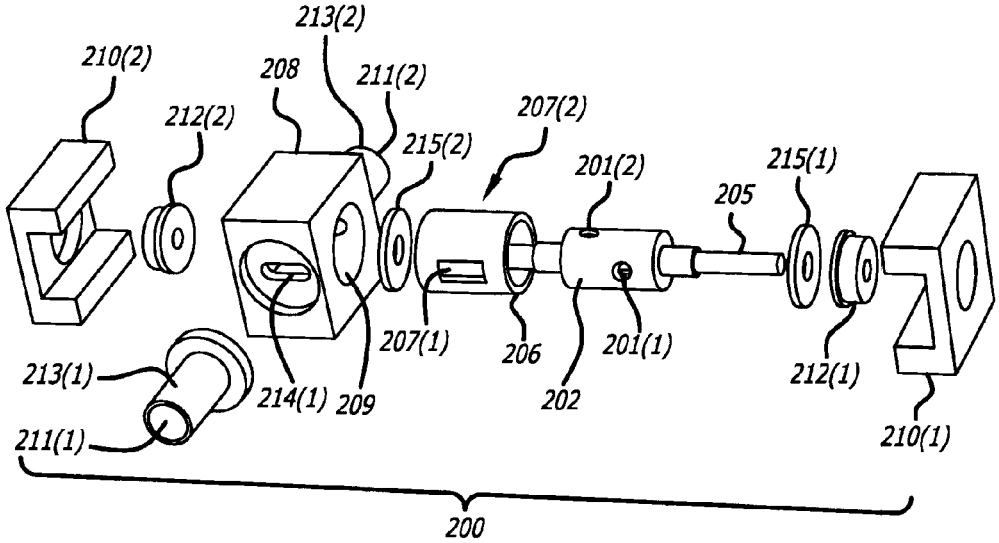
FIG. 2B

FIG. 5A
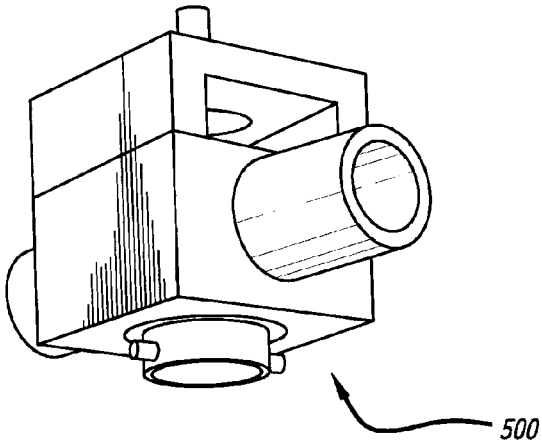
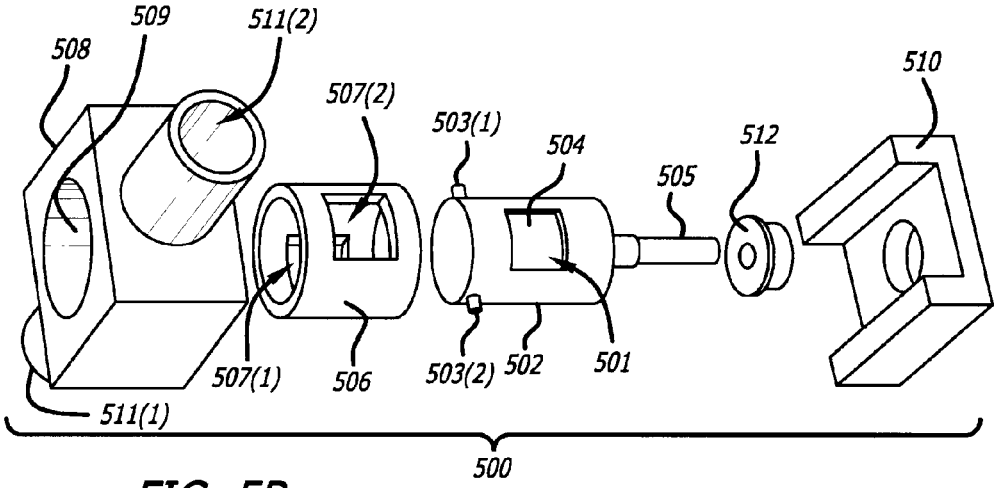
FIG. 5B

METERING AND PUMPING DEVICES

CROSS-REFERENCE TO RELATED APPLICATION

This application claims the benefit of U.S. Provisional Application Ser. No. 60/864,060, entitled "Metering and Pumping Devices," filed Nov. 2, 2006 and U.S. Provisional Application Ser. No. 60/864,291, entitled "Metering and Pumping Devices," filed Nov. 3, 2006; the entire contents of both of which applications are incorporated herein by reference.

GOVERNMENT INTEREST

This invention was made with government support under Office of Naval Research Grant No. N000140510850 awarded by the United States Government. The government has certain rights in the invention.

BACKGROUND

Fluidic delivery systems are employed for processing and/or delivering many different types of fluids for a wide range of applications. Such delivery systems can be tailored to the fluid(s) with which they are used, and can include metering (measuring or dosing) devices/apparatus. Often times such fluid delivery systems utilize an active pump of some kind such as a piston, turbine, or diaphragm.

Fluids including solid aggregates or large particles have proven to be problematic for fluid delivery devices and systems of the prior art often resulted in malfunctioning of valves and/or damaging the aggregates contained in the fluid Thus, there exists a need for techniques that provide improved performance characteristics useful for metering and pumping fluids that include solid aggregates.

SUMMARY

Embodiments of the present disclosure can provide techniques, e.g., apparatus and methods, useful for metering fluids with solid aggregates, e.g., such as concrete and various food products like creams with chocolate chips, and the like.

The present disclosure presents several exemplary embodiments for metering devices, some of which also have pumping capability. An advantage afforded by such embodiments is that they employ a minimal number of moving parts and do not explicitly use one way valves that are common in other metering devices and pumps. These features make the devices especially suitable for fluids with solid aggregates (e.g., such as concrete and various food products like creams with chocolate chips), which in the prior art have proven troublesome.

In certain exemplary embodiments, devices use passive pistons that, in conjunction with pressurized fluid supplied as input, perform only metering (or dosing) functions. In certain other exemplary embodiments, devices can utilize active pistons that can create pressure as well as suction, and therefore also act as pumps in addition to metering devices.

Various techniques useful in conjunction with the subject matter of the present application are described in: U.S. patent application Ser. No. 10/760,963, entitled "Multi-Nozzle Assembly for Extrusion of Wall," filed Jan. 20, 2004, which claims priority to and incorporates by reference U.S. Provisional Application Ser. No. 60/441,572, entitled "Automated Construction," filed Jan. 21, 2003; U.S. patent application Ser. No. 11/040,401, entitled "Robotic Systems for Automated Construction," filed Jan. 21, 2005; the entire contents of all of which applications are incorporated herein by reference.

Additional useful techniques are described in U.S. patent application Ser. No. 11/040,602, entitled "Automated Plumbing, Wiring, and Reinforcement," filed Jan. 21, 2005, and U.S. patent application Ser. No. 11/040,518, entitled "Mixer-Extruder Assembly," filed Jan. 21, 2005, all three of which claim priority to U.S. Provisional Application Ser. No. 60/537,756, entitled "Automated Construction Using Extrusion," filed Jan. 20, 2004; U.S. Provisional Applications: Ser. No. 60/730,560, entitled "Contour Crafting Nozzle and Features for Fabrication of Hollow Structures," filed Oct. 26, 2005; Ser. No. 60/730,418, entitled "Deployable Contour Crafting Machine," filed Oct. 26, 2006; Ser. No. 60/744,483, entitled "Compliant, Low Profile, Non-Protruding and Genderless Docking System for Robotic Modules," filed Apr. 7, 2006; the entire contents of all of which applications are incorporated herein by reference.

Additional useful techniques are described in U.S. Patent Application Ser. No. 60/807,867, entitled "Lifting and Emptying System for Bagged Materials," filed Jul. 20, 2006; U.S. patent application Ser. No. 11/552,741, entitled "Deployable Contour Crafting," filed Oct. 25, 2006, and U.S. patent application Ser. No. 11/552,885, entitled "Extruded Wall with Rib-Like Interior," filed Oct. 25, 2006; U.S. Provisional Patent Application Ser. No. 60/733,451, entitled "Material Delivery Approaches for Contour Crafting," filed Nov. 4, 2005, and U.S. Provisional Patent Application Ser. No. 60/820,046, entitled "Accumulator Design for Cementitious Material Delivery," filed Jul. 21, 2006, U.S. patent application Ser. No. 11/566,027, entitled "Material Delivery System Using Decoupling Accumulator," Behrokh Khoshnevis, Inventor; filed Nov. 2, 2006; and U.S. patent application Ser. No. 11/556,048, entitled "Dry Material Transport and Extrusion," filed Nov. 2, 2006; the entire content of all of which applications is incorporated herein by reference.

Other features and advantages of the present disclosure will be understood upon reading and understanding the detailed description of exemplary embodiments, described herein, in conjunction with reference to the drawings.

BRIEF DESCRIPTION OF THE DRAWINGS

Aspects of the disclosure may be more fully understood from the following description when read together with the accompanying drawings, which are to be regarded as illustrative in nature, and not as limiting. The drawings are not necessarily to scale, emphasis instead placed on the principles of the disclosure. In the drawings.

Figure 1A:
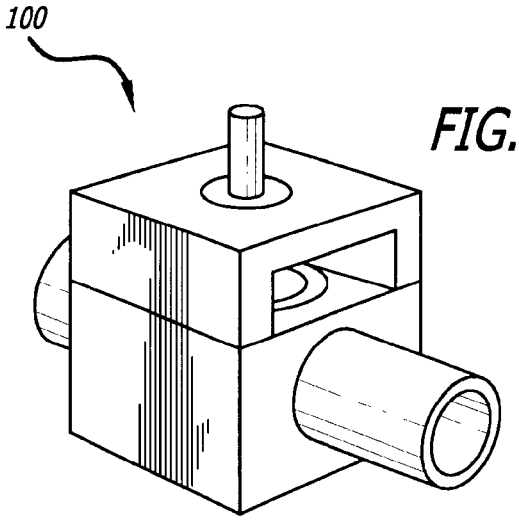
FIG. 1 includes FIGS. 1A-1C, which depict a perspective and exploded views of a metering device with a square piston according to an embodiment of the present disclosure.

While certain embodiments depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION

The present disclosure presents several embodiments for metering devices some of which also have pumping capability. The devices utilize one or more pistons located within a cylindrical rotor. It should be noted that as the term is used herein, "piston" includes reference to a device element of a desired shape (not necessarily cylindrical) that is used as a reciprocating element within a cylindrical rotor.

As the cylindrical rotor is turned by suitable torque/power source, a first face of each piston is exposed to an inlet supplying a pressurized fluid to be metered, e.g., a cementitious mix with aggregates. The piston then moves—either through applied power or by the force of the fluid within the associated channel or bore within the rotor, allowing the volume of the channel to be filled with fluid. The continuing rotational motion of the rotor then removes the piston from the fluid supply and moves the channel through an angular displacement (e.g., 180 degrees), where the piston is then moved—either through applied power for active piston embodiments or the force of the fluid supply in passive piston embodiments—in the opposite direction, forcing the fluid out of the channel. In this way, a precise amount of fluid (e.g., volumetric flow rate) can be metered from each channel, taking into consideration the speed of rotation of the rotor and the pressure of the fluid supply or power applied to the pistons.

An advantage of such embodiments is that they employ a minimal number of moving parts and do not explicitly use one way valves that are common in most other metering devices and pumps. These features make the devices especially suitable for fluids with solid aggregates (e.g., such as concrete and various food products like creams with chocolate chips), which in the prior art have often resulted in malfunctioning of valves and or damaging the aggregates included in the fluid.

As noted previously, certain exemplary embodiments are directed to metering devices that use passive pistons that, in conjunction with pressurized fluid supplied as input, perform only metering (or dosing) functions. In certain other exemplary embodiments, metering devices of the present disclosure can utilize active pistons that can create pressure as well as suction, and therefore can also act as pumps in addition to as metering devices.

Figure 1C:
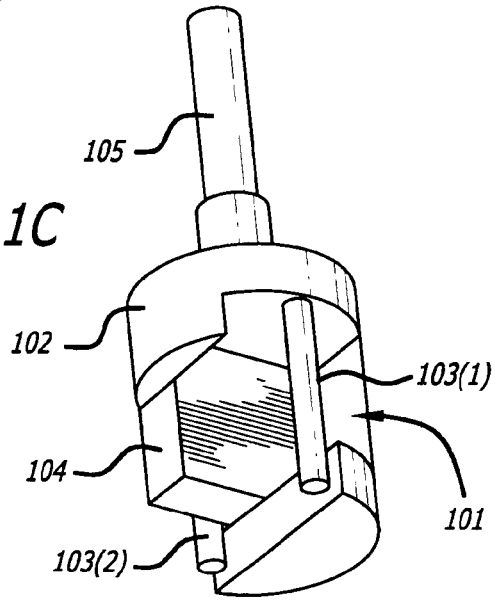
Figure 1B:
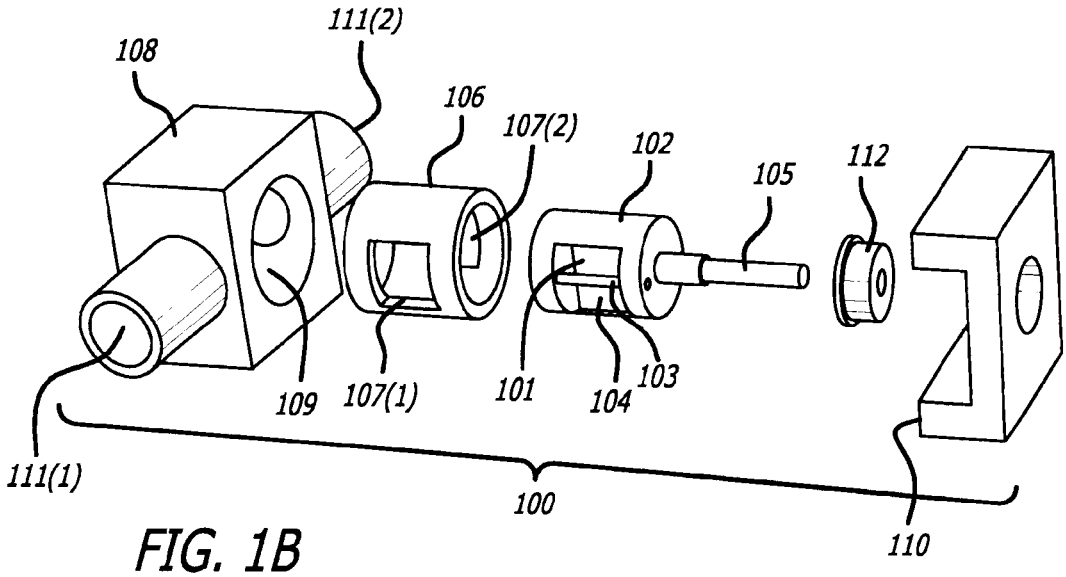

FIGS. 1A-1C depict perspective and exploded views of a metering device 100 with a passive square piston, according to an embodiment of the present disclosure The device 100 uses a square piston 104 that can freely reciprocate inside the channel 101 of a rotor 102. Pins 103 may be present within the rotor at opposing ends of the channel 101 to prevent the piston 104 from leaving the rotor 102.

The rotor 102 can be turned by an energized source such as an electric motor or the like and, to facilitate such, can include an extension 105. The rotor 102 is configured to spin inside a chamber of a chamber housing 106 that has openings 107(1)-107(2) for incoming and outgoing fluid volumes. In exemplary embodiments, the chamber housing 106 may be made of a suitable elastomeric material such as rubber, though other materials may be used. The chamber housing 106 itself can be located within a receiving aperture 109 of outer housing portion 108, which may be connected to fluid ports 111(1)-111(2) acting as inlet and outlet to the device 100. To facilitate the rotation of the rotor 102, one or more bearings, e.g., 112, may be positioned within outer housing portions 108 and 110.

With particular reference to the exploded view depicted in FIG. 1B, the operation of the device 100 can be understood. As the rotor is turned or rotated within the chamber housing 106 by the external power source (not shown), the piston 104 moves in an angular sense relative to the chamber housing opening, e.g., 107(2) that is connected to the fluid supply. During the rotation of the rotor 102, when the rotor channel 101 opening is positioned before the inlet, e.g., opening 107(2), the pressure of the incoming fluid, e.g., as supplied through inlet 111(2), pushes the piston 104 to its outmost opposite position along the channel 101. At that position, pin 103 prevents the piston 104 from emerging from the channel 101 of the rotor 102.

As the piston 104 moves away, incoming material (fluid) occupies the space in the channel 101 that the piston leaves behind (e.g., that is swept by the piston 104). As the rotor 102 continues to spin it locates the filled section of the channel 101 in front of the outlet, e.g., opening 107(1), while at the same time the opposite piston face, due to the rotation of the rotor 102, is positioned again in front of the opening (e.g., 107(2) corresponding to the inlet 111(2).

In the passive piston embodiment of FIG. 1, the pressure of the incoming fluid serves to push the piston away from the opening of the inlet. As it moves in response to the pressured supply of fluid, the piston 104 in turn pushes the material (e.g., fluid with aggregates) that had entered the channel 101 outward toward the outlet opening and to the outlet, e.g., port 111(1). This cycle continues twice per each revolution of the rotor 102. In this fashion, each half revolution doses (or meters) an amount of material (fluid) that has filled the channel 101 to capacity.

In this configuration the dosing (or metering) resolution of the device 100 is equivalent to the volume of the channel 101 minus the volume of the piston 104 itself, i.e., one channel capacity. The smaller the channel 101, the finer the dosing resolution of the device 100 becomes. For smaller channels 101, a faster rotor spin could result in comparable overall flow rate of a similar device that has a larger channel capacity but rotates at a slower speed. Thus, one skilled in the art can appreciate that the channel capacity may be designed by a combination of the piston size and rotor diameter (i.e., channel depth).

FIG. 2 includes FIGS. 2A-2F, which depict side, perspective, and exploded views, respectively, of a two-piston passive metering device 200, according to another embodiment of the present disclosure. The metering device 200 shown in FIGS. 2A-2F is similar to device 100 of FIG. 1, however it uses two cylindrical channels 201(1)-201(2) that are configured and arranged to receive corresponding cylindrical pistons 204(1)-204(2). Pins, e.g., 203(1)-203(2), may be present at outer positions of the channels 201(1)-201(2) to prevent the pistons 204(1)-204(2) from leaving the channels 201(1)-201(2) during operation of the device 200.

FIG. 2B shows an exploded view of device 200. As shown, channels 201(1)-201(2) are configured within cylindrical rotor 202 to hold corresponding cylindrical pistons 204(1)-204(2). A chamber housing 206 is configured to receive rotor 202 as rotor 202 is rotated. Similar to device 100 of FIG. 1, rotor 202 can have an extension (e.g., axle) to facilitate turning of the rotor, and such rotation may be accomplished by way of an external torque motor. The chamber housing 206 includes two openings 207(1)-207(2) that are suitable for connecting the chamber of the chamber housing to a fluid inlet and fluid outlet. A metering block 208 may be present and it may be configured with inlet and outlet openings 214(1)-214(2). The metering block may be connected to two ports 213(1)-213(2) connected to a fluid supply and a fluid exit. Outer housing portions 210(1)-210(2), bearings 212(1)-212(2), endplates 215(1)-215(2) may also be present as shown.

Figure 2C:
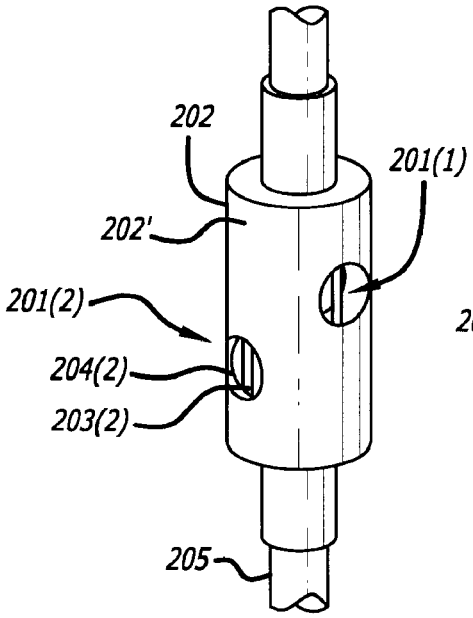
FIG. 2 includes FIGS. 2A-2F, which depict side, perspective, and exploded views of a metering device with cylindrical pistons and two channels according to another embodiment of the present disclosure.
Figure 2D:
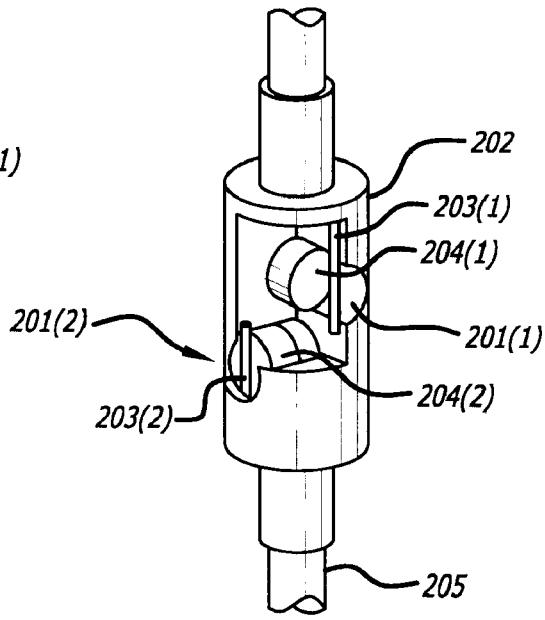

With particular reference to FIGS. 2C-2D, it can be seen that the two channels 201(1)-201(2) have an orthogonal orientation relative to one another within the rotor 202. In such a configuration, for each revolution of the rotor 202, the channels are filled and emptied a combined total of four times.

Figure 2E:
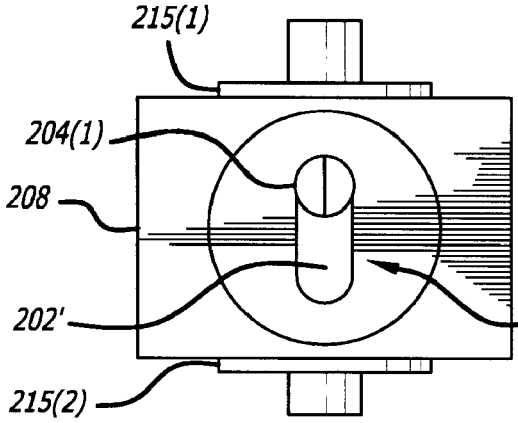
Figure 2F:
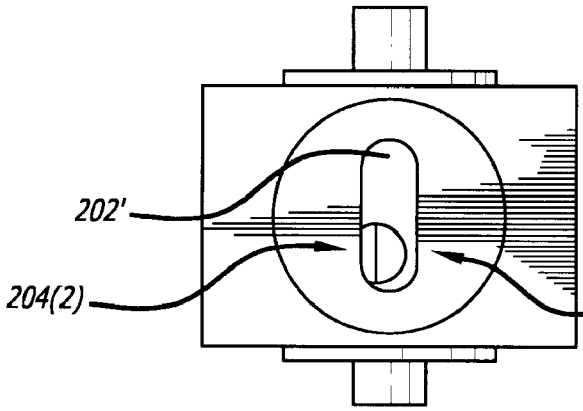

With reference to FIGS. 2E-2F, it can be seen that by properly sizing the diameter of the channels 201(1)-201(2), the diameter of the rotor 202, and the width of the inlet (or outlet) opening, e.g., opening 214(1), a maximum of one channel opening can always overlap the inlet (or outlet) opening, thereby maintaining the one channel capacity resolution for the device 200. This can be seen in the rotation progression of rotor 202 (within metering block 208) of FIGS. 2E-2F as the channels 204(1) and 204(2) alternate with the exterior surface 202' of the rotor 202. One skilled in the art will appreciate that while the channels 201(1)-201(2) are shown in an orthogonal configuration other configurations may also be used within the scope of the present disclosure.

Figure 3A:
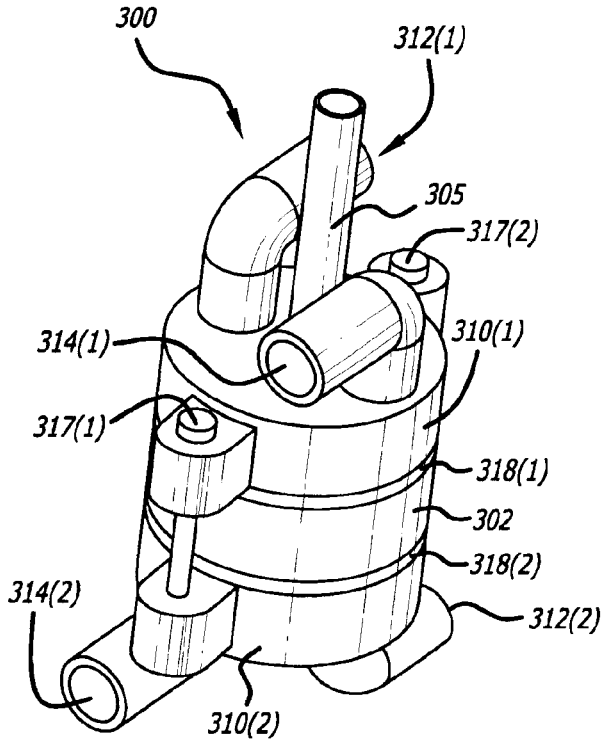
FIG. 3 includes FIGS. 3A-3C, which depict perspective and exploded views of a metering device with a quad chamber and double inputs and outputs, in accordance with a further embodiment of the subject disclosure.
Figure 3C:
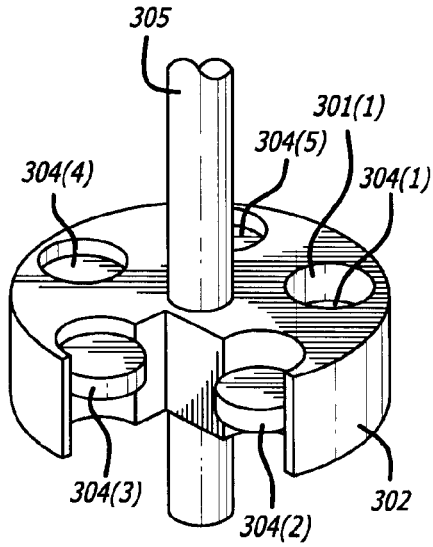
Figure 3B:
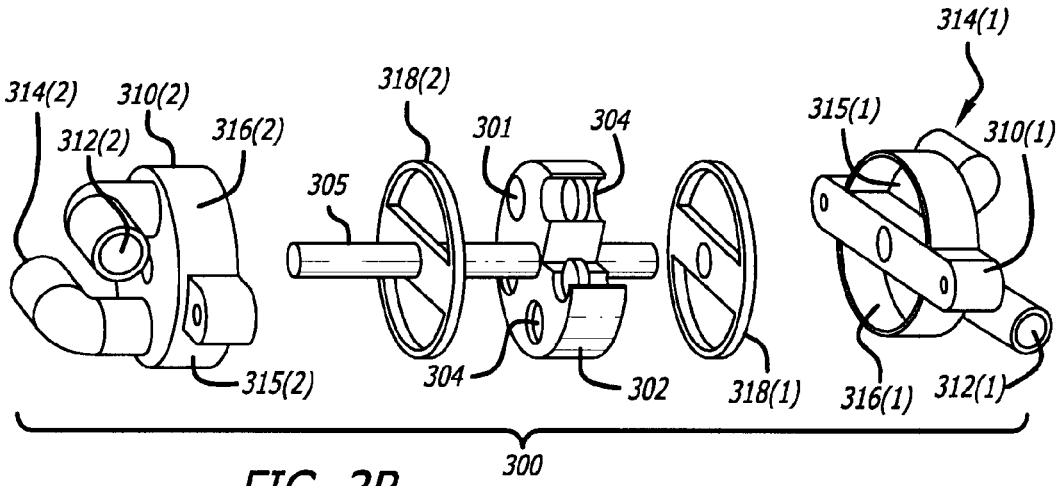

FIG. 3 includes FIGS. 3A-3C, which depict perspective and exploded views, respectively, of a metering device 300 with a quad chamber and double inputs and outputs, in accordance with a further embodiment of the subject disclosure.

The metering device 300 of FIGS. 3A-3C utilizes multiple channels 301(1)-301(5) to hold multiple reciprocating pistons 304(1)-304(5). The channels and pistons are configured in an orientation such that their reciprocating motion of the pistons is parallel to the direction of the rotor axis (in contrast the embodiments of FIGS. 1-2). While omitted for the sake of clarity, it will be understood that means to stop the pistons at the end of the channels are utilized. Such stopping means can be pins similar to previous embodiments of FIGS. 1-2, or other suitable mechanical features.

In the embodiment of FIG. 3, four chambers are used, two for incoming fluid 315(1)-315(2) and two for outgoing fluid 316(1)-316(2). The rotor 302 may turn about axle 305 and may be held between housing members (portions) 310(1)-310(2). In certain embodiments, the main portion of the rotor may be held between the housing members 310(1)-310(2), exposing the lateral surface of the rotor 302, as shown. The housing portions may include ribs, which can serve to separate the two chambers used for the incoming fluid from those used for the outgoing fluid. The ribs may also be used with external screws 317(1)-317(2) to hold the device 300 together. Gaskets 318(1)-318(2) of a material suitable for sealing device 300 may also be present. Suitable gasket materials include rubber and other elastomeric materials of sufficient durometer value.

In operation of device 300, pressurized fluid is supplied from inlets 314(1)-314(2) to the inlet chambers 315(1)-315(2) within housing members 310(1)-310(2). the pressurized incoming fluid push the pistons 304(1)-304(2) located in the corresponding channels 301(1)-301(4) (chambers) away from the fluid inlet chambers, e.g., chambers 315(1)-315(2). This action fills the volume of the respective channels on the incoming fluid side with fluid, while at the same time pushing the material (fluid) on the opposite side of the pistons 304(1)-304(2) to the corresponding outgoing chambers 316(1)-316(2) on the opposite side (relative to the rotor axial direction) of the previously described incoming fluid chambers 315(1)-315(2). A similar process takes place in the adjacent chambers but in reverse flow directions. The metered fluid then leaves outlet chambers 316(1)-316(2), leaving the device 300 through outlets 312(1)-312(2) connected to the housing members 310(1)-310(2).

It should be noted that device 300 can have two fluid inlets and two outlets, as shown. In exemplary embodiments, however, the two inlets and/or the outlets can be connected together to create a single inlet and a single outlet. The dosing (metering) resolution of this device 300 can be equivalent to the volume of each channel. Using a desired number of pistons, device 300 can be designed to deliver higher flow rates at slower rotational speeds.

In exemplary embodiment, device 300, when its two inlets 314(1)-314(2) and outlets 312(1)-312(2) are not connected together, can concurrently dose two separate fluids without mixing them. Besides the obvious advantage of the ability to dose double fluids at the same rate (such as dispensing equal amounts of vanilla and chocolate ice cream), the device can work as a pressure amplifier and thus active pump for one of the fluids. For example, high pressure water may be used as one incoming fluid and low pressure concrete as the second incoming fluid. In this case when the rotor is turned the concrete will be pushed out of the system at the high water pressure. The normal water line pressure or a powerful water pump may be used in this case. In case a pump is used the water may be recycled through a closed loop back to the pump. The pump in this case supplies pressure at its outlet and suction on its inlet. The suction action would pull the pistons positioned in the device 300 chamber which is connected to the water pump inlet and thus make it possible to suck in the second fluid material. Therefore, an unpressurized (i.e., at atmospheric pressure) material such as concrete at atmospheric pressure could be pumped by this arrangement. Note that the circulating fluid in this case may be a special oil (instead of water) which is commonly used in hydraulic actuators. In summary, in this closed loop case the high pressure water (or oil) circuit uses the inlet and outlet chambers on one side of device 300 and plays the role of a novel hydraulic pumping system to pump the material that enters and leaves respectively the inlet and outlet chambers on the opposite side of the device. Of course material flow takes place at the desired rate when the rotor in device 300 is turned by its own external torque source.

Figure 4A:
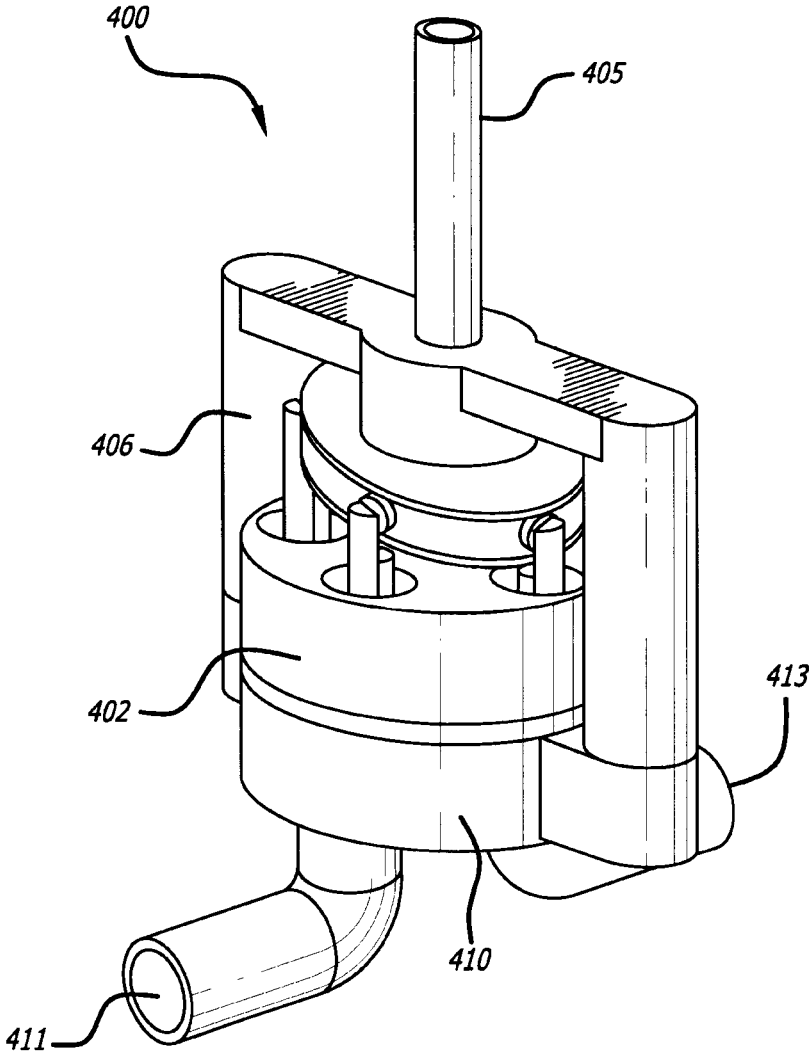
FIG. 4 includes FIGS. 4A-4B, which depict perspective and exploded views of a metering and active pumping device with continuous flow capability, in accordance with an exemplary embodiment of the present disclosure.
Figure 4B:
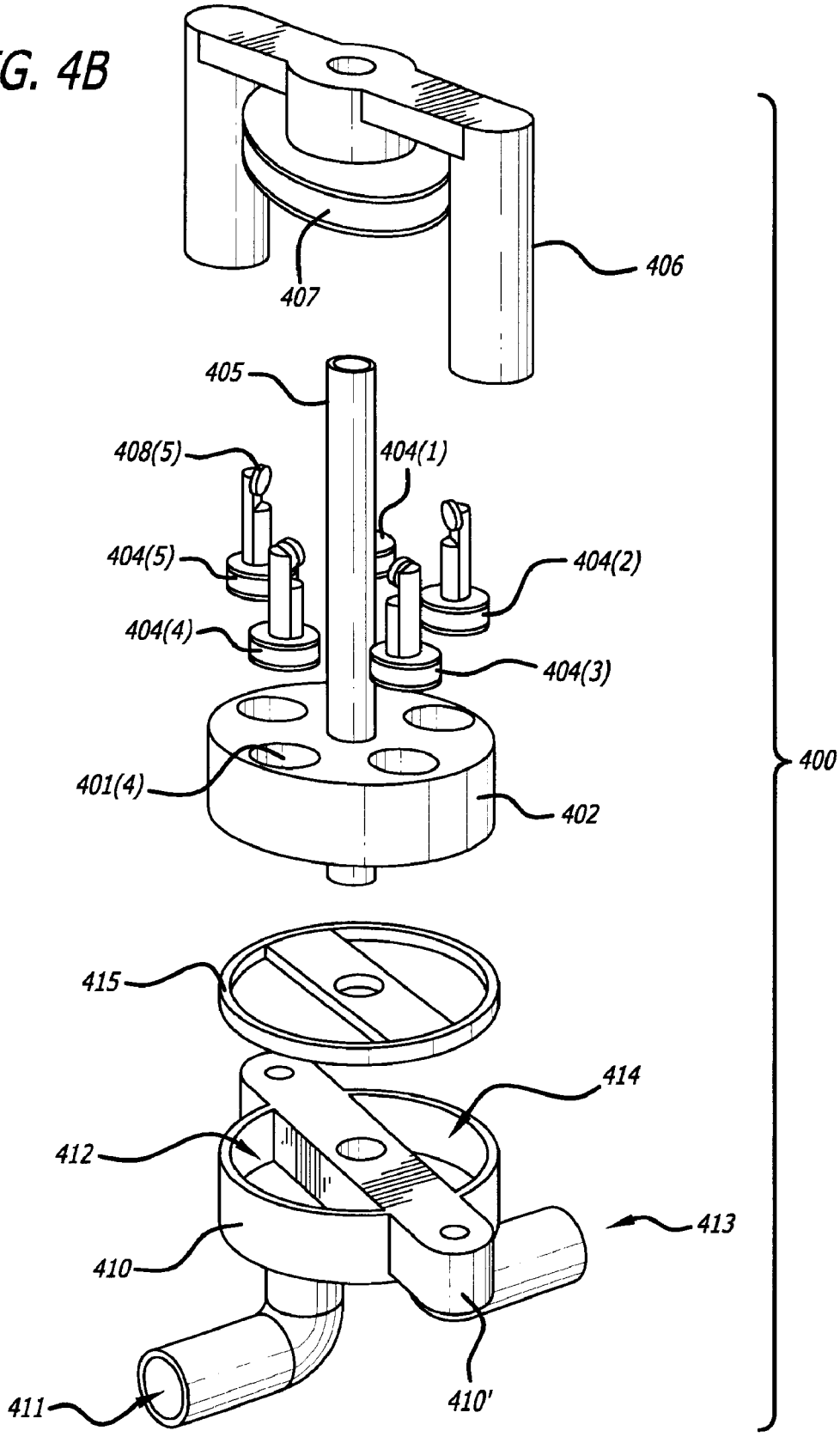

FIG. 4 includes FIGS. 4A-4B, which depict perspective and exploded views, respectively, of a metering and active pumping device 400 with continuous flow capability, in accordance with an exemplary embodiment of the present disclosure.

Like the previously described embodiments, device 400 includes a cylindrical rotor 402 that is turned by a torque applied to an extension (or axle) 405. Unlike previously described embodiment, however, device 400 uses active pistons 404(1)-404(5) that are actuated by means of their rods attached to bearings 408(1)-408(5) that move inside a tilted stationary groove 407 that is configured in an arched member 406 and that is tilted at oblique angle with respect to the axis of rotation of the rotor 402. The groove 407 is configured to retain the bearings 408(1)-408(5) in sliding manner such that the bearings 408(1)-408(5) are slidingly retained within the groove 407 as the rotor turns. The arched member 406 can receive axle 405 and be connected to housing member 410 that includes inlet chamber 412 and outlet chamber 414 connected to inlet 411 and outlet 413 respectively. Sealing gasket 415 may also be present.

In operation, as the rotor 402 is turned by an external torque source, the rotation of the rotor 402 forces each piston rod against the bearings which in turn causes their movement inside the grove 407. This arrangement results in the sequential rising and lowering of pistons 404(1)-404(5) in their respective channels 401(1)-401(5), thereby providing a pumping action for each. The rising action takes place above the incoming fluid chamber, e.g., chamber 412, and the lowing action happens above the outgoing fluid chamber, e.g., chamber 414. The dosing resolution in of the device 400 can thus be designed to be very fine, while allowing the flow through the device 400 to be continuous.

FIG. 5 includes FIGS. 5A-5G, which depict an exploded view and perspective views of a metering and active pump device 500 with pivoting piston providing continuous flow capability, according to a further embodiment of the present disclosure.

As can be seen in the exploded view of FIG. 5B, device 500 bears some similarity to device 100 of FIG. 1, and includes rotor 502 with channel 501 and piston 504. Rotor 502 is configured with axle 505 for rotation in chamber housing 506 having openings 507(1)-507(2). Chamber housing 506 is received within aperture 509 of housing member 508, which is connected to inlet and outlet ports 511(1)-511(2). Bearing 512 is present to receive axle 505 through housing member 510.

Figure 5C:
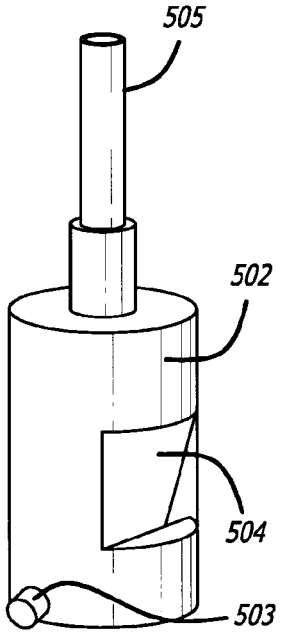
FIG. 5 includes FIGS. 5A-5G, which depict an exploded view and perspective views of a metering and active pump device with pivoting piston providing continuous flow capability according to a further embodiment of the present disclosure.
Figure 5D:
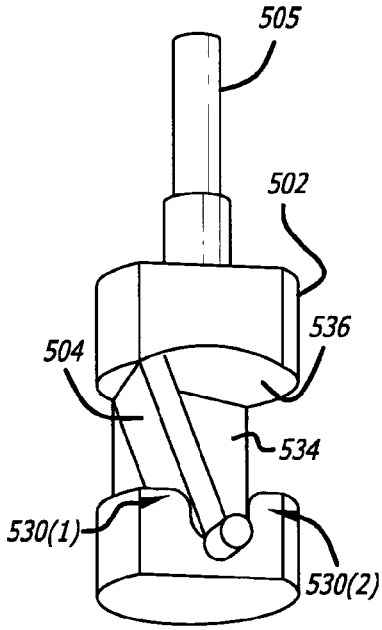
Figure 5E:
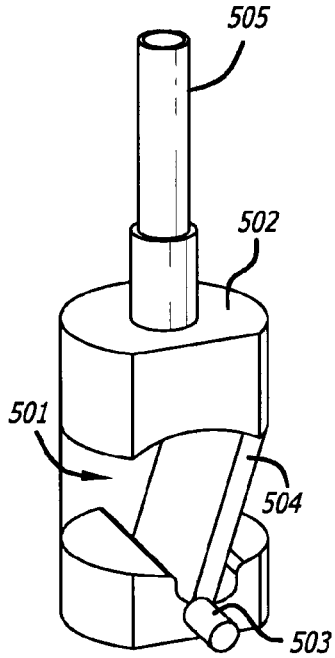

As can be seen in FIGS. 5C-5E, device 500 contrasts with device 100 of FIG. 1 in that piston 504 is a pivoting piston that pivots about axle 503, the ends of which protrude through the exterior surface of rotor 502. The piston 502 makes pivoting movement in two opposite direction within a volume that has a cylindrical surface 536 and two planar inner surfaces 534.

With continued reference to FIGS. 5C-5E, instead of stopping means in the form of pins, the rotor may be configured internally to include surfaces 530(1)-530(2) that act to restrain the pivoting motion of the piston 504, e.g., such that the piston end distal to pivot axle or shaft 503 is prevented from leaving the confines of the rotor 502 itself during operation of the device 500.

In certain embodiments, device 500 may be used in a passive mode with pressurized incoming fluid, in which case the dosing resolution will be equivalent to the channel containing the piston 504.

Figure 5F:
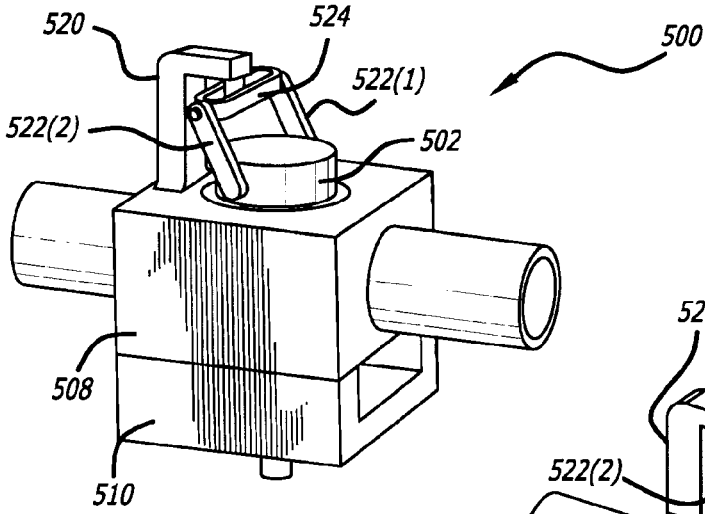
Figure 5G:
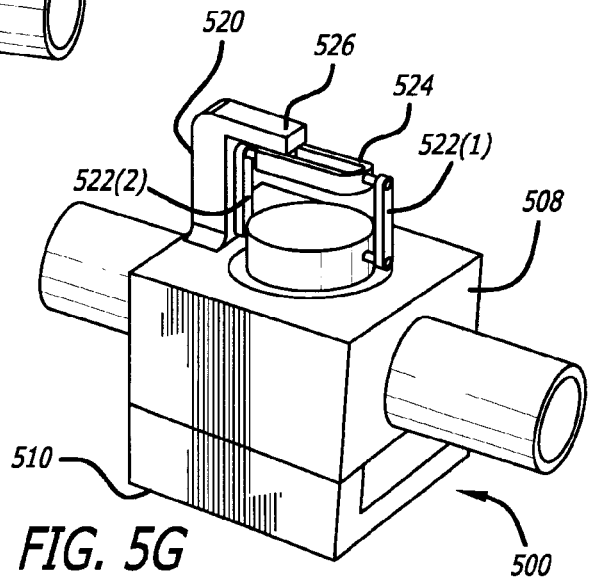

Due to its advantage of making the piston pivoting shaft ends 503(1)-503(2) available to outside the housing that contains the rotor, device 500 can be utilized as an active pump (or a continuous dosing device), as can be seen in FIGS. 5F-5G, in exemplary embodiments.

In such active embodiments, the rotor end spins with respect to the body of the housing 508. It is therefore possible to convert the rotary motion of the rotor 502 to reciprocating pivoting motion of the piston shaft by means of several possible rotary-to-reciprocating motion conversion mechanisms.

One possible mechanism is shown in (FIGS. 5F-5G). As shown, arms 522(1)-522(2) can be connected to the piston shaft 503 and also to member 524 that has a slot. The slot of member 524 (slide member) can be configured to receive pin 526 (FIG. 5G) which is held by arm 526 fixed to housing member 508. Thus in operation, during rotation of the rotor, the arm 520 and pin 526 cause an eccentric motion of arms 522(1)-522(2) connected to the piston 504, causing the piston to pivot back and forth in channel 501. In such active embodiments, all motion energy may be received from the same source that spins the main rotor.

While certain embodiments have been described herein, it will be understood by one skilled in the art that the methods, systems, and apparatus of the present disclosure may be embodied in other specific forms without departing from the spirit thereof. For example, in all of the above designs, a diaphragm or other alternatives to pistons may be used.

Accordingly, the embodiments described herein, and as claimed in the attached claims, are to be considered in all respects as illustrative of the present disclosure and not restrictive.

What is claimed is:

1. A fluid metering system comprising:

a cylindrical rotor having a channel completely through the rotor with opposing openings at each end of the channel configured to allow a fluid to flow within the channel, the rotor configured and arranged to receive a torque for rotation;

a piston disposed within the channel, wherein the piston is configured and arranged for slidable movement within the channel between a first position substantially blocking one opening of the channel and a second position substantially blocking the other opposing opening of the channel, wherein the movement of the piston is in response to a fluid pressure differential at the opposing ends of the channel; and a chamber housing having an interior configured and arranged to receive the rotor, the chamber housing further having first and second lateral openings configured and arranged to allow flow of a fluid through the interior during rotation of the rotor within the chamber as the piston reciprocates within the rotor channel between the first and the second positions.

2. The fluid metering system of claim 1, wherein the piston is a rectangular piston.

3. The fluid metering system of claim 1, wherein the piston is a circular piston.

4. The fluid metering system of claim 1, wherein the channel has a central axis that is substantially parallel to an axis of rotation of the rotor and wherein the piston moves along a oath that is substantially parallel to that axis of rotation when moving between the first and second positions.

5. The fluid metering system of claim 4 wherein the first and second lateral openings are on a same side of the chamber housing.

6. The fluid metering system of claim 5 wherein the fluid metering system is configured to meter the flow of a first fluid from the first opening to the second opening, wherein the chamber housing has third and forth lateral openings on an opposite side of the chamber housing configured and arranged to allow flow of a second fluid through the interior of the chamber housing in a manner that does not mix with the flow of the first fluid through the interior of the chamber housing.

7. The fluid metering system of claim 6 wherein the cylindrical rotor, the piston and the chamber housing are configured such that a fluid delivered under pressure to the third lateral opening increases the pressure of the fluid flowing from the second lateral opening.

8. The fluid metering system of claim 1, wherein the chamber housing comprises rubber.

9. The fluid metering system of claim 1, further comprising a torque motor configured and arranged to supply a torque to the rotor.

10. The fluid metering system of claim 1, wherein the channel has a central axis that is substantially perpendicular to an axis of rotation of the rotor and wherein the piston moves along a path that is substantially perpendicular to that axis of rotation when moving between the first and second positions.

11. The fluid metering system of claim 1, wherein:

the rotor has a second channel offset from the first channel and completely through the rotor with opposing openings at each end of the channel configured to allow a fluid to flow within the second channel;

the rotor has a second piston disposed within the second channel, wherein the second piston is configured and arranged for slidable movement within the second channel between a first position substantially blocking one opening of the second channel and a second position substantially blocking the other opening of the second channel, wherein the movement of the piston is in response to a fluid pressure differential at the opposing ends of the second channel; and the first and second lateral openings in the chamber housing are configured and arranged to allow flow of a fluid through the interior during rotation of the rotor within the chamber as the second piston reciprocates within the rotor channel between the first and the second positions within the second channel.

12. The fluid metering system of claim 1 wherein the first and second lateral openings are on a same side of the chamber housing.

13. The fluid metering system of claim 1 wherein the first and second lateral openings are on opposite sides of the chamber housing.

14. A fluid metering system comprising:

a cylindrical rotor having a channel completely through a diameter of the rotor with opposing openings at each end of the channel configured to allow a fluid to flow within the channel, the rotor configured and arranged to receive a torque for rotation;

a substantially rectangular piston disposed within the channel, wherein the piston includes a pivot shaft with shaft ends held by the rotor, wherein the piston is configured and arranged to pivot between a first position and a second position within the channel of the rotor; and a chamber housing having an interior configured and arranged to receive the rotor, the chamber housing further having first and second lateral openings configured and arranged to allow flow of a fluid through the interior during rotation of the rotor within the chamber as the piston pivots within the rotor channel between the first and the second positions.

15. The fluid metering system of claim 14, wherein the shaft ends are configured and arranged to protrude from the rotor, and wherein the system further comprises:

an arm connected to the chamber housing;

a pin held by the arm;

a pair of shaft arms, each rigidly connected to one of the shaft ends; and a link having a slot therein configured and arranged to receive the pin, and wherein the link pivotably connects to each of the arms, wherein during rotation of the rotor, the piston pivots back and forth in the channel due to force asserted by the pin to the link as it slides within the slot therein.

16. A fluid metering system comprising:

a pumping and metering chamber;

a first inlet configured to receive a first fluid and to deliver the first fluid into the pumping and metering chamber;

a first outlet configured to receive the first fluid from the pumping chamber and to deliver it away from the pumping and metering chamber; and a second inlet configured to receive a second fluid and to deliver the second fluid into the pumping and metering chamber; and a second outlet configured to receive the second fluid from the pumping chamber and to deliver it away from the pumping and metering chamber, wherein the pumping and metering chamber is configured to transfer energy cause by pressure in the first fluid at the first inlet to the second fluid, thereby increasing the pressure of the second fluid at the second outlet as compared to the pressure of the second fluid at the second inlet.

17. A fluid metering system of claim 16 wherein the pumping and metering chamber is configured to keep the first and the second fluids separate so that they do not mix.

18. A fluid metering system of claim 17 wherein the pumping and metering chamber includes a cylindrical rotor and a piston configured to slide within the cylindrical rotor.

19. A fluid metering system of claim 18 wherein the piston has a first surface and an opposing second surface and wherein the pumping and metering chamber is configured such that the first fluid can only come in contact with the first surface of the piston and the second fluid can only come in contact with the second surface of the piston.

* * * * *